US005522487A

United States Patent [19]

Nordstrom

[11] Patent Number: 5,522,487

[45] Date of Patent: Jun. 4, 1996

[54] WHEELED SOFT LUGGAGE

[75] Inventor: Mark Nordstrom, Brentwood, Tenn.

[73] Assignee: Lenox, Incorporated, Lawrenceville, N.J.

[21] Appl. No.: 257,556

[22] Filed: Jun. 10, 1994

[51] Int. Cl.[6] ..... A45C 5/14; A45C 13/04; A45C 13/10; A45C 13/36

[52] U.S. Cl. ..... 190/18 A; 190/119; 190/122; 190/127; 206/287.1

[58] Field of Search ..... 190/18 A, 115, 190/119, 127, 903, 122; 206/287.1

[56] References Cited

U.S. PATENT DOCUMENTS

| | | | |
|---|---|---|---|
| 2,606,636 | 8/1952 | Braverman | 190/113 X |
| 2,717,671 | 9/1955 | Arnold et al. | 206/287.1 X |
| 2,839,167 | 6/1958 | Smith | 206/287.1 X |
| 2,985,266 | 5/1961 | Pelavin | 190/127 |
| 3,292,748 | 12/1966 | Rifkin | 190/903 X |
| 4,210,230 | 7/1980 | Weiner | 190/127 X |
| 4,703,519 | 10/1987 | Krenzel | 190/903 X |
| 4,753,342 | 6/1988 | Pulichino, Jr. et al. | 206/287.1 X |
| 4,998,603 | 3/1991 | Nordstrom | 190/18 A |
| 5,113,982 | 5/1992 | Pulichino et al. | 190/18 A |
| 5,330,049 | 7/1994 | Bertelsen et al. | 190/127 X |

FOREIGN PATENT DOCUMENTS

| | | | |
|---|---|---|---|
| 948385 | 1/1949 | France | 190/119 |
| 4314401 | 11/1992 | Japan | 190/127 |

*Primary Examiner*—Sue A. Weaver
*Attorney, Agent, or Firm*—Eckert Seamans Cherin & Mellott

[57] ABSTRACT

An article of soft luggage, preferably a folding garment bag, has a soft shell forming outer walls, with wheels on the outer bottom wall and a flange and pocket engagement that fixes the bottom walls together when the bag is folded. The bottom wall is partitioned into left and right portions due to folding over of the ends of the bag, which has an inverted U-shape when closed and resting on the wheels. To stiffen the bottom walls of the left and right portions, and provide a mounting for the wheels, relatively stiffer gussets are affixed to the left and right cooperative portions, respectively. The two cooperative portions are connected by a flexible closure such as a zipper when the bag is closed. The zipper or the like defines a flexible seam that normally would permit the cooperative portions to be displaced relative to one another, for example rotating around the longitudinal axis of the zipper, interfering with positioning of the wheels mounted on each cooperative portion. However, a flange forming a tenon is affixed to the planar member of one cooperative portion, and protrudes beyond the zipper to engage in a pocket forming a mortise in the other cooperative portion. The pocket is defined between the planar member of the other cooperative portion and portions of its soft shell and holds the bottom walls of the cooperative portions coplanar, thereby maintaining the correct positioning of the wheels notwithstanding the flexible closure of the zipper.

7 Claims, 4 Drawing Sheets

WHEELED SOFT LUGGAGE

BACKGROUND OF THE INVENTION

1. Field of the Invention

The invention relates to the field of wheeled luggage, and in particular concerns luggage made of flexible material and having a bottom wall carrying wheels, casters or rollers. The bottom wall is divisible into two parts and the wheels or rollers are mounted respectively on each of the two parts.

The luggage can form a fold at a top wall opposite from the divisible bottom wall. The two parts of the bottom wall are preferably attachable and a closure such as a zipper, which may extend around the ends to the top, forms a flexible seam between two cooperative halves or portions. The zipper or similar closure, provides access to the interior between the cooperative halves, including at the bottom wall. This form of soft luggage is advantageously dimensioned as a full-length garment carrier for receiving unfolded, hanging garments when the two portions of the bag are unfolded. The invention is also applicable to embodiments that fold more than once upon themselves.

2. Prior Art

Luggage packing garments or clothing and the like has popularly been packed in soft-shelled luggage, i.e., having side walls formed of flexible fabric, plastic or combinations of these materials, generally with reinforcements along comer seams and at handle attachments and the like. The popularity of soft-shelled luggage is in part due to its ability to inflate or deflate in accordance with the volume of the garments and personal effects packed therein. Additionally, soft luggage is somewhat deformable, and even when fully and tightly packed, can conform to the available space for stowing in odd-shaped compartments such as overhead compartments in airplanes and the like. Soft luggage is also relatively lighter than comparable-sized hard luggage, which means less strain on owners who must carry the luggage about and hoist their luggage up into the overhead compartments.

A further development in luggage, which also is popular, is the addition of wheels or rollers permanently mounted on the luggage for rolling the luggage along a support surface. Wheeled luggage permits pedestrians to transport a greater weight of luggage across the pedestrian surface for a greater distances with less exertion than comparable luggage which must be carried (and not rolled).

It would be advantageous if soft luggage, particular relatively large garment bags, could also take advantage of wheels or rollers for obtaining the benefits of both in one article of luggage. However, prior attempts to provide a workable wheeled soft bag, especially a garment bag, have been plagued by shortcomings.

Some shortcomings of the prior art relate to the bottom wall of the soft luggage. Typically, an article of soft luggage has a soft shell forming its outer walls, which include namely side, top and bottom walls. Wheels or rollers are mounted on the bottom wall and the bag is manipulated by a handle on the opposite or top wall. For a foldable garment bag, the fact that the bottom wall is partitioned into left and right parts presents a problem. The parts can be attached, for example, by a central zipper extending across the middle of the bottom wall, i.e., between the two parts of the bag. The garment bag typically is folded such that the packed garments reside in the bag in an inverted U-shape. This forms a more convenient parcel than an unfolded full length bag, that must be carried by the user in a full length mode or folded anyway, e.g., over an arm. Full length bags are unpopular because they are difficult to carry, bulky and ill-suited to fit in overhead compartment, under a seat or like.

Assuming that a fold is needed, an inverted U-shape is preferable over an upright U-shape. An upright U-orientation would provide a continuous central bottom that could bear wheels, but is impractical because gravity pulls the end portions of the folded garments downward on one or both sides (e.g., on the side without a hanger hook), resulting in undesirable wrinkling at the bottom of the U. In an inverted U-shape, the garments are better supported at the middle, and are less inclined to bunch up in either side. A horizontal or inclined-U orientation is possible but would be impractical because the luggage is too low at the "top" wall to be conveniently manipulated by the user.

Since the most practical orientation is luggage which packs the garments in an inverted-U orientation, then that orientation defines the problem, which is a bottom wall with two portions, both having rollers, and presumably with a zipper or other closure attaching the sides and extending among the rollers.

Two wheels could be provided for partial support of the bag. For stability in standing, three or four rollers are advantageous. The rollers can be mounted on the bottom wall in a rectangular arrangement in which two rollers are mounted on the left part of the bottom wall and two other rollers are mounted on the right pan. This arrangement permits the garment carrier to be rolled in a direction with the side edges of the garments leading and trailing, with the user walking close alongside the garment carrier in convenient reach of the handle.

A truly soft shell bag has little or no shape stability, i.e., the soft shell is unable to support itself in a vertical plane. To stiffen the bottom wall of the garment carrier, the soft shell is reinforced with U-shaped gussets, one each for each of the left and right parts of the bottom wall. The wheels or rollers are fixed in a stable manner to these gussets, as the soft shell is not wholly suitable for mounting wheels. The left and right gussets are affixed to the left and right parts of the soft shell in the bottom wall, respectively. However, there is no rigid interconnection between the left and right gussets, the connection consisting of the zipper, which when closed defines a flexible seam between the left and right gussets.

This arrangement is disadvantageous because the gussets are interconnected with some freedom to pivot relative to each other about a pivot axis defined along the zipper. When the bag is lifted or caused to bear weight on the wheels, the wheels splay outwardly or inwardly, which also may occur as a function of the extent to which the bag is packed full. The gusset on one side may be higher or lower than the other. It is difficult with unstable or splayed wheels to roll the garment carrier along with generally equal distribution of the load to all four wheels. Experience shows that the two wheels on the same left or right gusset generally carry the weight while the other two wheels idle. An additional aspect of the problem is that the known garment carrier rolls forward unstably, with the user's side-to-side gait displacement tending to shift the load from one set of weight-carrying wheels to the other. At each lateral shift, the garment carrier tends to lurch away from a straight line path. The same structural deficiencies prevent the garment carrier from standing stable at rest. The garment carrier has a tendency to rock away over the pair of wheels that happen to be carrying less of the weight than the other set of wheels.

SUMMARY OF THE INVENTION

It is an object of the invention to provide rolling stability to wheeled soft luggage of the type that has a flexible seam attaching two parts having roller mounts on the outer bottom wall.

It is another object of the invention to provide the above wheeled soft luggage with a detachable structural engagement traversing the flexible seam, to provide positional stability to the outer bottom wall, and thus increase rolling stability, regardless of variations in packing and loading.

It is a further object to provide a tongue and groove arrangement traversing the flexible seam to hold the bottom wall planar despite being partitioned by a flexible seam.

It is an additional object of the invention that the above groove is defined between the soft shell of the soft luggage and one of the stiffener plates that are customarily used to stiffen the respective halves of the outer bottom wall.

These and other aspects and objects are provided according to the invention in a wheeled article of luggage that has a flexible shell that forms the outer walls of the article of luggage. These outer walls include side, top and bottom walls, preferably in a generally rectangular shape.

The outer bottom wall is made up of cooperative left and right portions. Left and right planar members, which are relatively stiffer than the soft shell, are affixed to the left and right cooperative portions, respectively. The left and right cooperative portions are interconnected by a zipper or similar flexible fastening element. The zipper can be opened and closed and, while closed, the zipper holds the cooperative portions adjacent one another. However, the zipper does not provide planar stability between the adjacent cooperative portions and merely defines a flexible seam between the cooperative portions. Wheels or rollers are mounted on each the cooperative portions.

According to an inventive aspect, planar stability between the flexibly coupled cooperative portions is provided in part by a flange affixed to the planar member of one cooperative portion. This flange is sized and arranged to extend out from this one cooperative portion, in a plane generally parallel with the one cooperative portion, across and over the zipper.

To complement the flange, there is a pocket, associated with the planar member of the other cooperative portion, arranged and sized for receiving the flange in a tongue and groove or mortise and tenon arrangement. More particularly, this pocket is defined between (1) the planar member that is affixed to this other cooperative portion and (2) portions of the soft shell of this same other cooperative portion.

In use, the cooperative portions are positioned in registry, with their bottom walls coplanar for defining generally a bottom plane of the article of luggage. The flange and pocket interfit to hold the walls in position, making the overall bottom wall planar and stable and preventing displacement around an axis corresponding to the closed zipper. The result is increased standing and rolling stability of the article of luggage and a neater and more unitary appearance. Although flexible, the folding garment bag or the like is more nearly shaped like a unitary bag, especially at the wheel-supporting bottom.

The bag is preferably a folding garment carrier. The bag can be stretched flat open, with the end panels at opposite ends. An inventive aspect of this garment carrier is that the end panels are simply the ends of the cooperative portions. Thus, the end panels are positionable adjacent one another when the garment carrier is folded shut, cooperatively defining the outer bottom wall, and the stable planar wheeled bottom, of the garment carrier.

The zipper is only an example of a suitable fastening element deployable with the luggage of the invention. Other similar fastening elements include cooperating pairs of snap fasteners, cooperating buttons and holes, and cooperating hook and pile strips. The fastening elements can be of any type providing edgewise interconnection to the adjacent cooperative portions, and closable access to an interior compartment of the article of luggage.

Each of the planar members is optionally arranged in a U-shape, with a planar web portion extending between opposite arm portions. The arm portions can provide dimensional stability to the outer side walls of the article of luggage. For example, the article of luggage preferably has a generally rectangular shape, at least when closed shut, and the arms provide dimensional stability to the rectangular side walls. That is, the arms directly reinforce the lower portions of the opposite side walls which the arms occupy. The arms indirectly support the other opposite side walls, which extend perpendicular to and across between the arms, in the manner that a flexible sheet can be stretched between spaced rails or the like. The web portions between the arm portions are generally equal in size and have generally planar rectangular shapes, with a relatively shorter dimension in the lateral direction.

The article of luggage can be made from many materials, and due to the dimensional stability of the bottom can be light and flexible. Preferred flexible materials include pliable synthetic material, such as nylon, or pliable material of natural fiber, such as canvas or felt and the like. The planar members, as well as the flange, advantageously can be made of a polymer or resinous moldable material, a pressed material, a paperboard material or the like. It is not necessary that the planar members or flange be perfectly rigid or heavy, because the structure is improved provided they have relatively greater stiffness than the soft shell which generally lacks the ability to support its shape.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
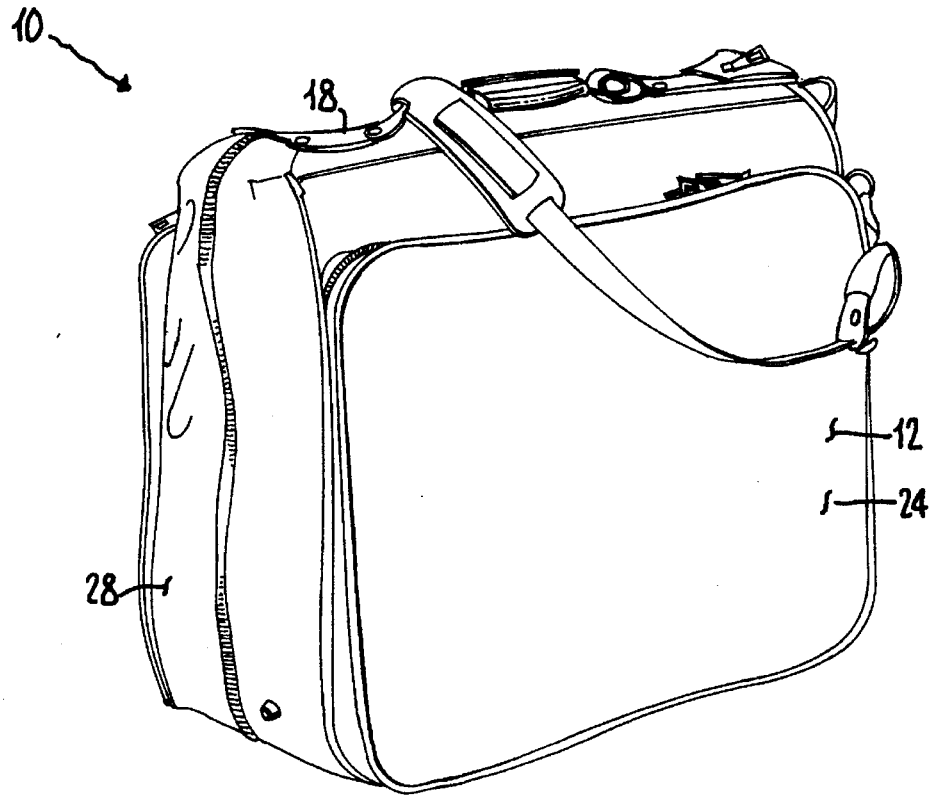
FIG. 1 is a perspective view of a wheeled garment bag according to the invention in a closed position.
Figure 2:
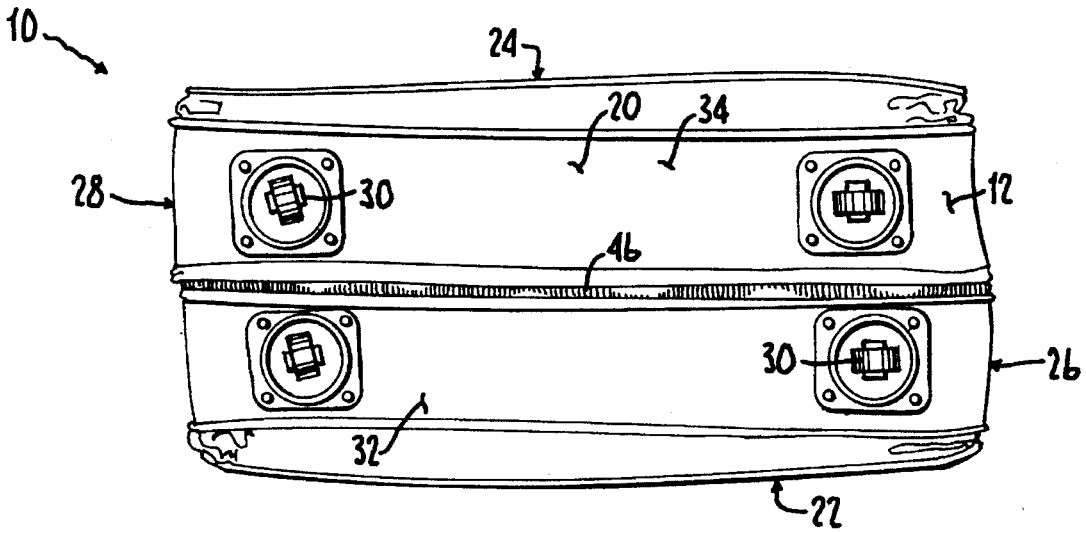
FIG. 2 is a bottom plan view thereof.

In FIGS. 1 and 2, a Wheeled article of soft luggage 10 according to the invention has a soft shell 12 that forms the outer walls 18–28 of the article of luggage 10. These outer walls 18–28 include top and bottom walls 18 and 20, and four side walls 22, 24, 26 and 28, which together form a generally rectangular shape. Wheels or rollers 30 are mounted on the bottom wall 20. In FIG. 1, the outer bottom wall 20 is shown horizontal and resting on the wheels or rollers 30. However, the article of luggage 10 can be oriented in other orientation when appropriate. As shown in FIG. 2, the outer bottom wall 20 is partitioned, with the bag being subdivided at the lower end into abutting parts 32, 34.

The bag can be placed on any of its sides, and has two parts 32, 34 that can be separated and oriented vertically or horizontally independent of one another, but for their attachment to top wall 18. Nevertheless, terms like "top", "bottom", and "side", "front" and "back", "left" and "right" and so on are used in this description for convenience and refer to the orientation of the bag as seen in FIG. 1, i.e., upright on its wheels. These orientation terms are not intended to refer otherwise to the use of the article of luggage 10 or to be limiting in any way.

Figure 5:
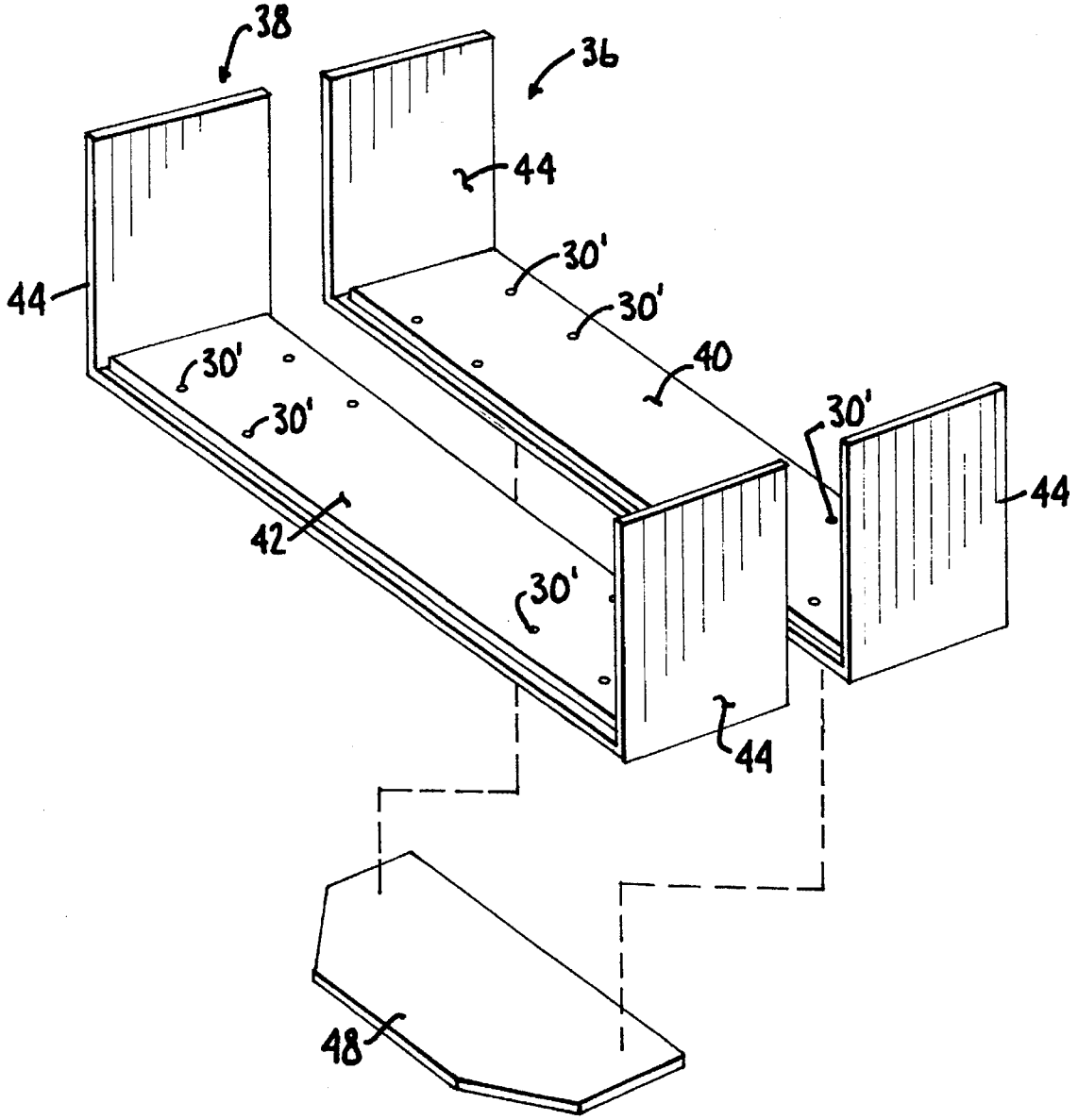

The two parts 32 and 34 of the bottom wall 20, on opposite sides of a central partition formed by zipper or fastener 46, are the ends of cooperative left and right portions that preferably have equal thickness. These cooperative portions 32 and 34 form portions of the soft shell 12 and would lack good dimensional stability absent a stiffening means for providing a structure for attachment of the wheels or rollers 30, among other things. To provide the requisite stiffness, left and right gussets 36 and 38 are provided and are shown apart from the soft shell 12 in FIG. 5. Gussets 36, 38 are relatively stiffer than the soft shell 12 and are affixed to the left and right cooperative portions 32 and 34 respectively.

Each gusset 36 and 38 is configured in a U-shape, having a planar web portion 42 extending between opposite arm portions 44. The arm portions 44 provide dimensional stability to the outer side walls 22, 24, 26 and 28 of the article of luggage 10. For example, the article of luggage 10 preferably has a generally rectangular shape, at least when closed shut (see FIG. 1), and the arms 44 provide dimensional stability to the rectangular side walls 22, 24, 26 and 28. The arms 44 occupy lower portions of the opposite front and back side walls 26 and 28 and thus directly reinforce the lower portions of the front and back sidewalls 26 and 28. Additionally, the arms 44 indirectly support the left and right side walls 22 and 24 which extend between them and are held in tension to some extent, e.g., when the bag is tightly packed.

Web portions 40 and 42 are generally equal in size and have generally planar rectangular shapes with a relatively shorter dimension in the left to right direction, arms 44 being perpendicularly coupled to the ends of webs 40, 42. Each web portion 40 and 42 is formed with spaced patterns of holes 30' for the mounting of the rollers 30.

With reference to FIGS. 1 and 2, the left and right cooperative portions 32 and 34 are coupled by a zipper 46 when the bag is folded and closed as shown. Other fastening elements that hold portions 32, 34 in abutment against separating laterally can be substituted for zipper 46, for example, cooperating pairs of snap fasteners, cooperating buttons and holes, cooperating hook and pile strips, belts and other typically flexible fasteners. The fastening elements preferably provide edgewise interconnection between the cooperative portions while positioned adjacent one another, and openable/closable access to an interior compartment of the article of luggage 10 (see FIG. 3 and 4).

Zipper 46, when closed, releasably secures the cooperative portions 32 and 34 in an adjacent and edgewise relationship. Zipper 46, like other similar fastening elements, has no structure capable of holding the bottom wall cooperative portions 32 and 34 coplanar. Zipper 46 only defines a flexible seam, and regardless of the stiffness of gussets 36, 38, would allow pivoting of the bottom wall portions around the longitudinal axis of the zipper. The zipper 46 extends between the rollers 30 on the outer bottom wall 20, partitioning the rollers 30 into one set of two rollers 30 on each of the cooperative portions 32 and 34.

Figure 3:
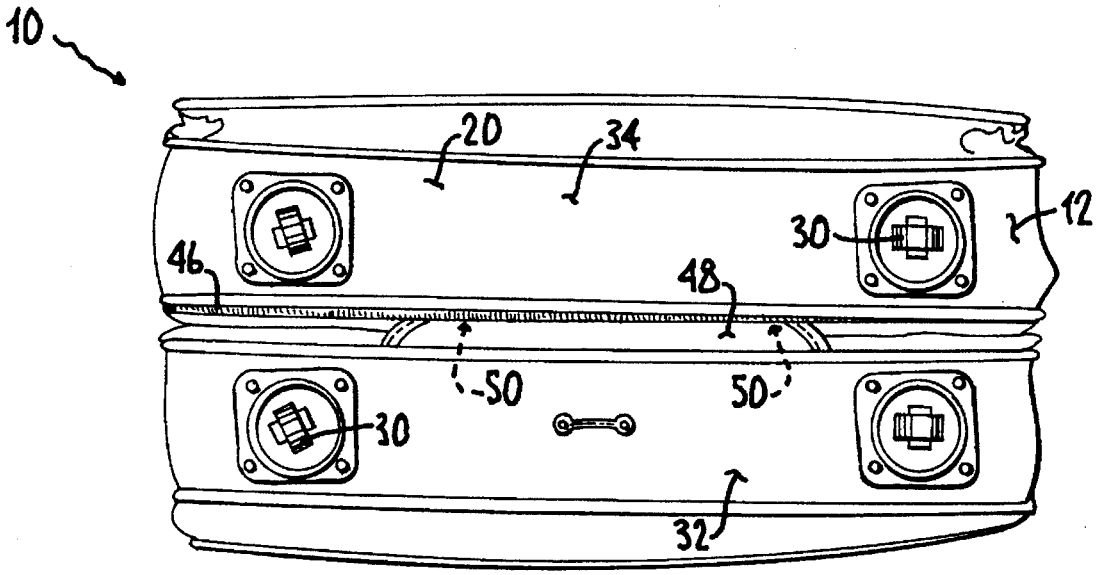
FIG. 3 is a bottom plan view corresponding to FIG. 2 except that the zippered ends are slightly apart.
Figure 4:
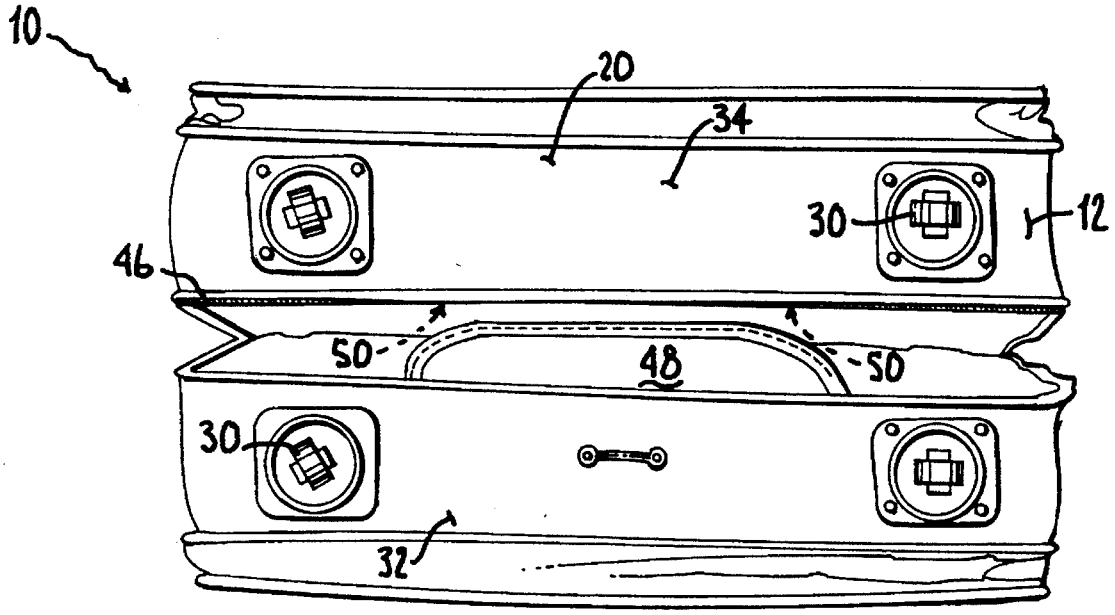
FIG. 4 is a bottom plan view corresponding to FIG. 3 except that the zippered ends are further slightly apart; and, FIG. 5 is a perspective view of the gussets that give a stable shape to the zippered ends.

FIGS. 3 and 4 show an inventive aspect of this article of luggage 10 in that planar stability is imparted to the bottom wall notwithstanding the flexible seam at the zipper. A flange 48 is affixed to the left planar web portion 40 (see FIG. 5) and/or left cooperative portion 32. Flange 48 is dimensioned and arranged to protrude from the left cooperative portion 32, in a plane generally parallel with the left cooperative portion 32, over (relative to the orientation in FIG. 1) and beyond the zipper 46. The right planar web portion 42 and portions of the soft shell 12 of the right cooperative portion 34 define a pocket 50 to complement and receive flange 48. More particularly, the pocket 50 is arranged and dimensioned for receiving the flange 48 in a close fitting relationship.

In use, the cooperative portions 32 and 34 are placed in registry adjacent to one another (i.e., in sequence of FIGS. 4 to 2) for defining generally a bottom plane of the article of luggage 10. In so doing, flange 48 engages in pocket 50, both flange 48 and pocket 50 being fixed relative to their respective gussets 36, 38, such that the bottom walls of portions 32, 34 are positively positioned relative to one another, i.e., in the same plane. In FIG. 2, the flange 48 and pocket 50 cooperatively hold the planar web portions 40 and 42, and hence the cooperative portions 32 and 34, coplanar across the closed zipper 46. This increases the rolling and standing stability of the article of luggage 10 on a support surface (not shown).

Figure 6:
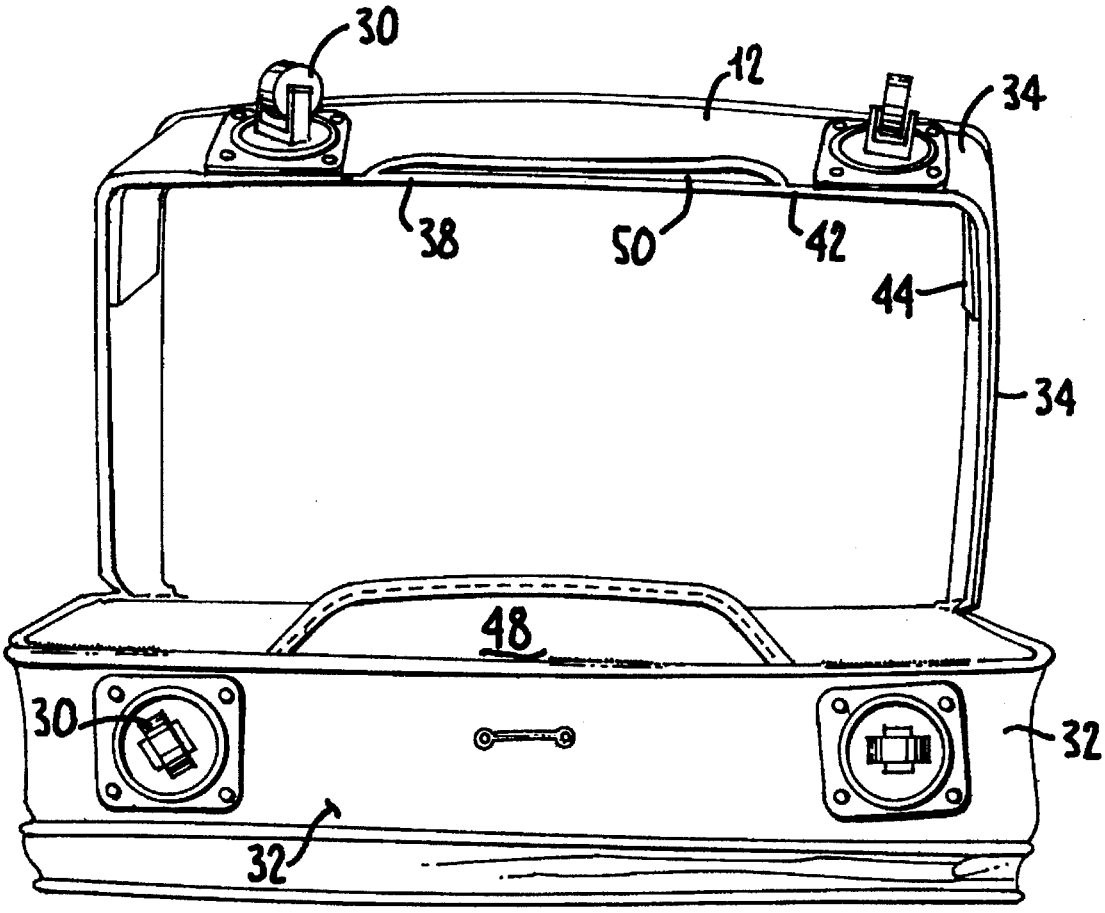
FIG. 6 is an elevation view of the garment bag in a further open position, for showing the configuration of the bottom walls.

FIGS. 4 and 3 show the closing operation in sequence, wherein the flange 48 is extended progressively farther into the pocket 50 which can be seen in FIG. 6, wherein the garment bag is more widely open. The flange 48 fits easily in pocket 50. In FIG. 2, the zipper 46 is closed, and urges flange 48 and pocket 50 to remain engaged in the manner of a tongue and groove or mortise and tenon joint. Preferably, the soft shell 12 of both cooperative portions 32 and 34 are slightly extended under tension when the zipper is closed, such that flange 48 is firmly clamped between the right planar web portion 42 and covering portions of soft shell 12 in the right cooperative portion 34.

Referring to FIG. 1, outer walls 18–28 preferably define a garment carrier type of bag. This garment carrier 10 can be stretched flat when opened fully or hung by one end (not shown) in which case end panels 32 and 34 are at opposite ends, as is typical of unfolded garment bags. It is an inventive aspect of this luggage, however, that the spaced end panels 32 and 34 that normally would be relatively independent end structures, become joined into a dimensionally stable end more typical of a unitary bag, when the bag is folded and zipped closed. The end panels 32 and 34 register when the garment carrier 10 is folded shut, as seen in FIG. 1, for holding packed items in a unitary manner. The garment carrier 10 is opened to the stretched-flat position for removal of packed items or packing and repacking and so on. In the shut position (i.e, FIG. 1), the end panels or cooperative portions 32 and 34, reform as the generally-planar, wheeled bottom wall 20 of the now-unitary garment carrier 10.

The article of luggage 10 can be made from various suitable materials. The soft shell 12 can comprise one or more of a pliable synthetic material that can be in sheet or fabric form, for example nylon, pliable material of natural fiber, such as canvas or felt, and other flexible material suitable to protect the contents of the bag. The U-shaped gussets 26 and 38 with the planar webs 40 and 42, as well as the flange 48, can comprise a polymer or resinous moldable material, or a pressed material or paperboard or the like. It is not necessary that the U-shaped gussets 36 and 38, or the flange 48, be perfectly rigid, but rather that they have a relatively greater stiffness than the soft shell 12, which ordinarily lacks any general dimensional stability, including the ability to support itself in an upright posture.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. An article of luggage comprising:

a soft shell forming outer walls of the article of luggage, which outer walls include side, top and bottom walls;

the outer bottom wall including cooperative left and right portions;

left and right planar members, which are relatively stiffer than the soft shell and are affixed to the left and right cooperative portions respectively;

fastening means for interconnecting the cooperative portions, the fastening means having secured and unsecured positions and defining a flexible seam between the cooperative portions in the secured position;

at least one roller mounted on each cooperative portion;

a planar flange affixed to the planar member of one of the cooperative portions and arranged to protrude beyond the fastening means; and, the soft shell at a bottom wall of an other of the cooperative portions being secured at spaced edges to the associated planar member and extending over the planar member of said other of the cooperative portions, such that a pocket is defined between the soft shell and the planar member of said other of the cooperative portions, said pocket being arranged and sized for receiving the flange; and, wherein the cooperative portions are positionable coplanar with one another for defining generally a bottom plane, and the flange and pocket engage in the secured position of the fastening means to hold the planar members substantially in coplanar position across the flexible seam.

2. The article of luggage of claim 1, wherein the outer walls define a garment carrier type of luggage, having a stretched flat open position in which the garment carrier extends between spaced end panels defined respectively by the cooperative portions, the garment carrier being folded in an inverted U-shape for engaging the flange and pocket means.

3. The article of luggage of claim 1, wherein the fastening means provides closable access to an interior compartment of the article of luggage.

4. The article of luggage of claim 1, wherein each planar member is arranged in a U-shape with a planar web portion extending between opposite arm portions, the arm portions providing dimensional stability to the outer side walls of the article of luggage.

5. The article of luggage of claim 1, wherein the rollers comprise two sets of two rollers, each set being mounted on one of the cooperative portions.

6. The article of luggage of claim 1, wherein the cooperative portions are generally equally sized rectangular portions with a relatively shorter dimension in the left to right direction.

7. An article of luggage comprising:

a soft shell forming outer walls of the article of luggage, which outer walls include side, top and bottom walls;

the outer bottom wall including cooperative left and right portions;

left and right planar members, which are relatively stiffer than the soft shell and are affixed to the left and right cooperative portions respectively;

fastening means for interconnecting the cooperative portions, the fastening means having secured and unsecured positions and defining a flexible seam between the cooperative portions in the secured position;

at least one roller mounted on each cooperative portion;

a flange affixed to the planar member of one of the cooperative portions and arranged to protrude beyond the fastening means;

wherein that planar member that is affixed to other of the cooperative portions and portions of the soft shell of said other cooperative portion define a pocket arranged and sized for receiving the flange;

wherein the cooperative portions are positionable coplanar with one another for defining generally a bottom plane, and the flange and pocket are cooperative to hold the planar members substantially in coplanar position across the fastening means in the secured position.

* * * * *